US008096632B2

(12) United States Patent
Ihara

(10) Patent No.: US 8,096,632 B2
(45) Date of Patent: Jan. 17, 2012

(54) LIQUID EJECTING APPARATUS AND METHOD FOR CONTROLLING LIQUID EJECTING APPARATUS

(75) Inventor: Seiji Ihara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 338 days.

(21) Appl. No.: 11/836,702

(22) Filed: Aug. 9, 2007

(65) Prior Publication Data

US 2008/0036807 A1 Feb. 14, 2008

(30) Foreign Application Priority Data

Aug. 9, 2006 (JP) ..... 2006-216430

(51) Int. Cl.
*B41J 29/38* (2006.01)

(52) U.S. Cl. ..... 347/11; 347/9; 347/10

(58) Field of Classification Search ..... 347/9, 10, 347/11, 12

See application file for complete search history.

(56) References Cited

U.S. PATENT DOCUMENTS

| | | | | |
|---|---|---|---|---|
| 2002/0024546 | A1 * | 2/2002 | Chang | 347/9 |
| 2003/0146742 | A1 * | 8/2003 | Nishida et al. | 347/19 |
| 2006/0209108 | A1 * | 9/2006 | Hamazaki et al. | 347/11 |

FOREIGN PATENT DOCUMENTS

| | | | |
|---|---|---|---|
| JP | 09-141851 | | 6/1997 |
| JP | 09141851 | A * | 6/1997 |
| JP | 2001-150672 | | 6/2001 |
| JP | 2001-270092 | | 10/2001 |
| JP | 2003-165220 | | 6/2003 |
| JP | 2005-280199 | | 10/2005 |

* cited by examiner

*Primary Examiner* — Matthew Luu
*Assistant Examiner* — Jannelle M Lebron
(74) *Attorney, Agent, or Firm* — Maschoff Gilmore & Israelsen

(57) ABSTRACT

A liquid ejecting apparatus includes a liquid ejecting head with a pressure chamber communicating with a nozzle opening and a pressure generator capable of causing a pressure fluctuation to liquid in the pressure chamber. The liquid ejecting head discharges liquid droplets by operating the pressure generator. The drive signal generator generates a drive signal including a drive pulse which includes a first expanding element that expands the pressure chamber, a first discharging element that contracts the pressure chamber expanded by the first expanding element in order to discharge a liquid droplet, a second expanding element that expands the pressure chamber, and a second contracting element that contracts the pressure chamber. The time from the beginning of the first discharging element to the end of the second contracting element is set to ½ to 1 of the natural vibration period of the liquid in the pressure chamber.

7 Claims, 6 Drawing Sheets

LIQUID EJECTING APPARATUS AND METHOD FOR CONTROLLING LIQUID EJECTING APPARATUS

BACKGROUND

The entire disclosure of Japanese Patent Application No. 2006-216430, filed Aug. 9, 2006 is expressly incorporated herein by reference.

1. Technical Field

The present invention relates to a liquid ejecting apparatuses. More specifically, the present invention relates to liquid ejecting apparatuses capable of controlling the discharge of liquid droplets from each nozzle opening by controlling the supply of a drive pulse to a pressure generator.

2. Related Art

A liquid ejecting apparatus typically has a liquid ejecting head which is capable of discharging various liquids from the liquid ejecting head in the form of droplets. Examples of common liquid ejecting apparatuses are image recording apparatuses such as ink jet printers, which perform a recording process by discharging (ejecting) liquid ink onto recording paper in a series of dots. In recent years, liquid ejecting apparatuses have been used not only in image recording apparatuses but also in various other manufacturing apparatuses. For example, in display apparatuses, such as liquid crystal displays, plasma displays, organic EL (Electro Luminescence) displays, or FEDs (Field Emission Displays), liquid ejecting apparatuses are used for discharging various liquid materials, such as color materials or electrode materials onto pixel forming regions or electrode forming regions.

Ink jet printers (hereinafter simply referred to as printers) include a recording head (a kind of liquid ejecting head) and a drive signal generating circuit. The recording head has nozzle openings and pressure generating elements. Each nozzle opening communicates with a pressure chamber. Each pressure generating element can initiate a fluctuation in the ink pressure in the corresponding pressure chamber. The drive signal generating circuit generates a drive signal including a drive pulse. The drive pulse is supplied to each pressure generating element, thereby activating each pressure generating element. As the pressure is applied to the pressure chamber, ink is discharged from the nozzle openings as ink droplets.

An example of a ink jet printer is found in Japanese Patent Application, JP-A-2005-280199, which discloses a printer wherein a discharge pulse in the drive pulse includes a discharging element that discharges ink and a damping element that controls the vibration of the meniscus (the free surface of ink exposed at each nozzle opening) after a discharge. For example, the discharge pulse may control the vibration of the meniscus by supplying each pressure generating element with an expanding element and a holding element after ink is discharged while expanding the corresponding pressure chamber so that the ink pressure is reduced.

Recently, such printers have begun discharging minute droplets in order to enhance image quality, by using a drive pulse capable of discharging minute ink droplets. In addition, recording speeds have increased, meaning that the interval between successively discharged ink droplets is decreased and the interval between successive discharge pulses in a drive pulse has also decreased.

One difficulty in such printers is that the rapid expansion and contraction of the pressure chamber causes the meniscus to vibrate significantly. Typically, a damping element which expands the pressure chamber so as to reduce the ink pressure is not sufficient to dampen the vibration of the meniscus in the required amount of time. Thus, when dots (minute ink droplets) are successively discharged from the same nozzle, the time from the discharge of dot 1 to the discharge of dot 2, i.e., must be long enough to stabilize the vibration of the meniscus, as shown in FIG. 7, meaning that it is difficult to speed up recording using minute ink droplets.

BRIEF SUMMARY OF THE INVENTION

An advantage of some aspects of the invention is that the vibration of the liquid in a pressure chamber can be quickly stabilized after a minute droplet is discharged and the rate of discharge of the minute liquid droplets can be increased.

One aspect of the invention is a liquid ejecting apparatus which includes a liquid ejecting head and a drive signal generator. The liquid ejecting head has a pressure chamber which communicates with a nozzle opening and a pressure generator capable of causing a pressure fluctuation in the liquid in the pressure chamber. The liquid ejecting head discharges the liquid in the pressure chamber in the form of liquid droplets due to the operation of the pressure generator. The drive signal generator generates a drive signal including a drive pulse for driving the pressure chamber to discharge a liquid droplet. The drive pulse includes a first expanding element that expands the pressure of the chamber from normal capacity, a first discharging element that contracts the pressure chamber expanded by the first expanding element in order to discharge a liquid droplet, a second expanding element which expands the pressure chamber contracted by the first discharging element, and a second contracting element that contracts the pressure chamber expanded by the second expanding element. The time from the beginning of the first discharging element to the end of the second contracting element is set to ½ to 1 of the period of the natural vibration of the liquid in the pressure chamber.

According to another aspect of the invention, a method is for controlling a liquid ejecting apparatus including a liquid ejecting head and a drive signal generator. The liquid ejecting head has a pressure chamber, a pressure generator capable of causing a pressure fluctuation to liquid in the pressure chamber, and a drive signal generator capable of generating a drive signal including a drive pulse which drives the pressure chamber to discharge a liquid droplet from the liquid ejecting head. The method includes generating a drive pulse which includes a first expanding element which expands the pressure chamber from its normal capacity, a first discharging element that contracts the pressure chamber expanded by the first expanding element in order to discharge a liquid droplet, a second expanding element that expands the pressure chamber contracted by the first discharging element, and a second contracting element that contracts the pressure chamber expanded by the second expanding element. The method further includes setting the time from the beginning of the first discharging element to the end of the second contracting element to ½ to 1 of the natural vibration period of the liquid in the pressure chamber.

One advantage of embodiments of the invention is that because the time from the beginning of the first discharging element to the end of the second contracting element is ½ to 1 of the natural vibration period of the liquid in the pressure chamber, the liquid in the pressure chamber after the discharge can be quickly stabilized. Thus, the residual vibration of the liquid in the pressure chamber can be quickly dampened, and the time between discharges of a liquid droplets can be shortened, and the recording time can be improved.

In another embodiment, the time from the beginning to the end of the second expanding element is set to less than or equal to the period of the natural vibration of the pressure generator. Advantageously, since the time from the beginning to the end of the second expanding element is set to less than or equal to the natural vibration period of the pressure generator, the vibration due to the natural vibration period of the pressure generator can be prevented from affecting the liquid in the pressure chamber.

In another embodiment, the time from the beginning of the second expanding element to the beginning of the second contracting element is set to less than or equal to the natural vibration period Ta of the pressure generator. Since the time from the beginning of the second expanding element to the beginning of the second contracting element is set to less than or equal to the natural vibration period of the pressure generator, the vibration due to the natural vibration of the pressure generator can be prevented from affecting the liquid in the pressure chamber. Therefore, destabilization of the liquid in the pressure chamber after the discharge of a liquid droplet can be prevented, and the residual vibration of liquid can be easily converged. Thus, the time between discharges of a liquid droplets can be shortened, and the recording time can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
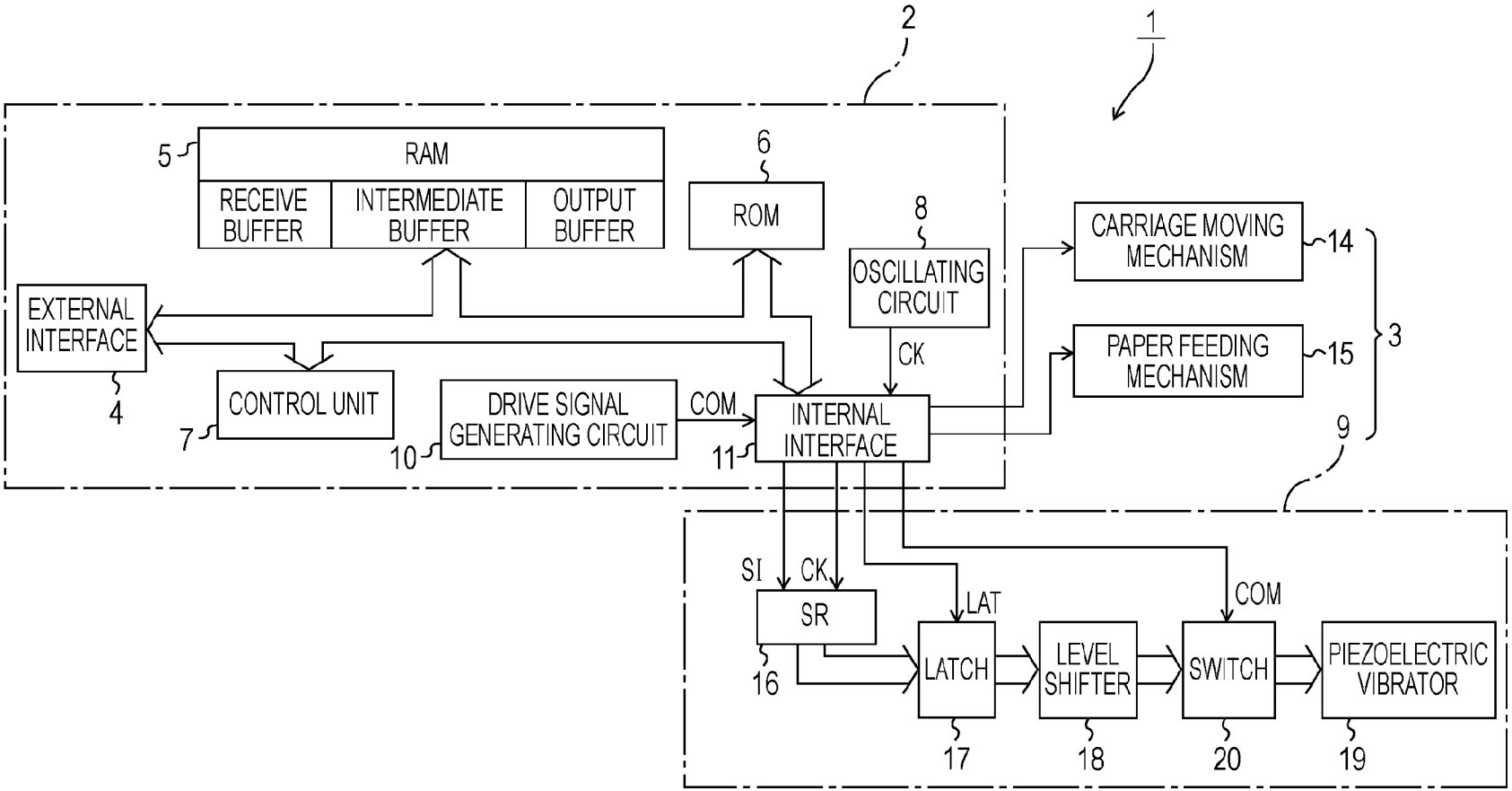
FIG. 1 is a functional block diagram of an ink jet printer.

The exemplary embodiments of the invention will now be described with reference to the drawings. An ink jet printer (hereinafter referred to as printer 1) is used as an example of a liquid ejecting apparatus of the invention. FIG. 1 is a functional block diagram of the printer 1.

As shown in FIG. 1, the printer 1 includes a printer controller 2 and a print engine 3. The printer controller 2 includes an external interface 4, a RAM 5, a ROM 6, a control unit 7, an oscillating circuit 8, a drive signal generating circuit 10, and an internal interface 11. Print data from an external device, such as a host computer (not shown), is inputted into the external interface 4. The RAM 5 stores various data. The ROM 6 stores a control routine for processing various data. The control unit 7 includes a CPU. The drive signal generating circuit 10, corresponds to a drive signal generator, and generates a drive signal that is supplied to a recording head 9. The internal interface 11 outputs discharge data obtained by converting the print data on a dot by dot basis and sending the drive signal to the print engine 3.

The control unit 7 controls each section of the printer 1 according to an operating program stored in the ROM 6. The control unit 7 converts print data input from an external device through the external interface 4 into discharge data used for discharging ink droplets in the recording head 9.

Figure 3:
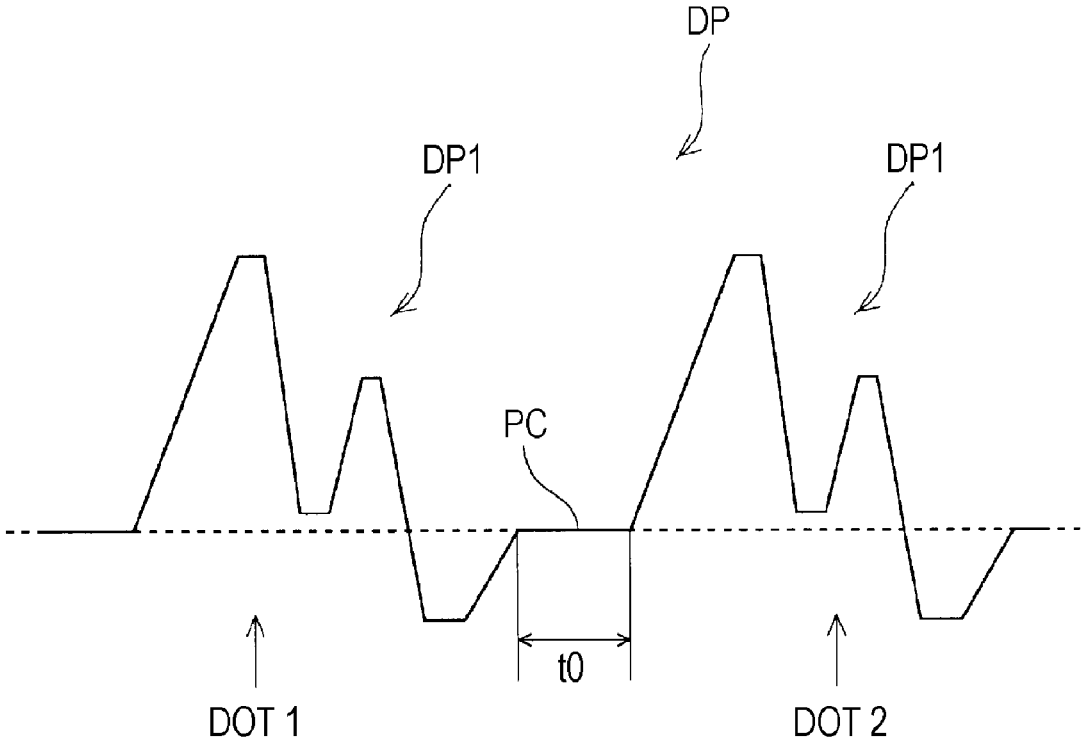
FIG. 3 illustrates a drive pulse.

The drive signal generating circuit 10 generates a drive signal in the form of a wave determined by the control unit 7. As shown in FIG. 3, the drive signal includes a drive pulse DP including a plurality of successively disposed discharge pulses (small dot discharge pulses DP1) and will be described more fully below. The drive signal is supplied to the recording head 9 through the internal interface 11.

The print engine 3 includes a recording head 9, a carriage moving mechanism 14, and a paper feeding mechanism 15. The recording head 9 is attached to a carriage. The carriage moving mechanism 14 moves the carriage in the width direction of the recording paper (main scanning direction). The paper feeding mechanism 15 transports recording paper in the paper feeding direction which is perpendicular to the moving direction of the recording head 9 (sub-scanning direction). The recording head 9 is a kind of liquid ejecting head. The recording head 9 includes a shift register (SR) 16, a latch circuit 17, a level shifter 18, piezoelectric vibrators 19, and a switch circuit 20. Recording data are set in the SR 16. The latch circuit 17 latches the recording data set in the shift register 16. The level shifter 18 functions as a voltage amplifier. The switch circuit 20 controls the supply of the drive signal to the piezoelectric vibrators 19.

Figure 2:
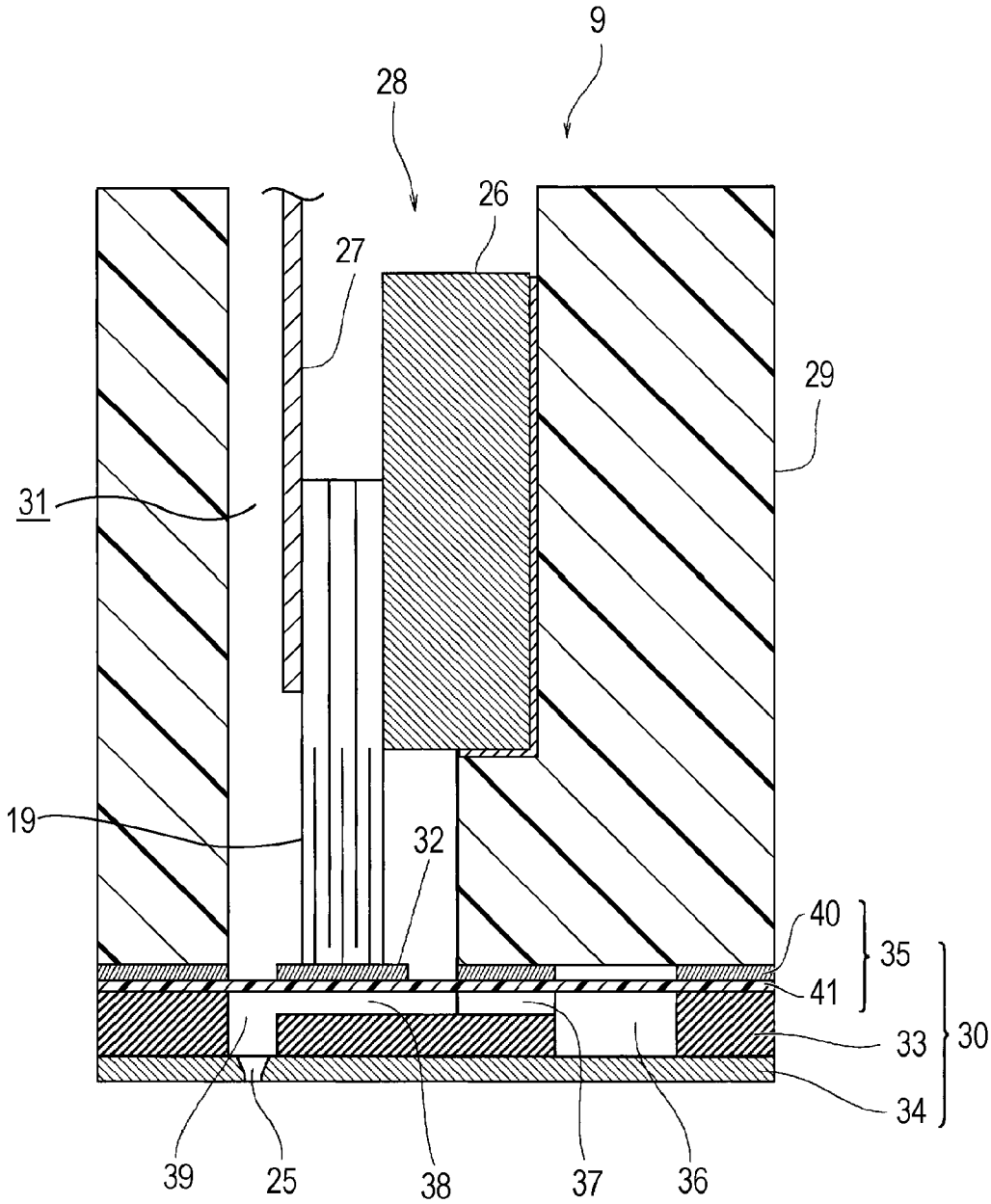
FIG. 2 is a sectional view illustrating the structure of a recording head.

The structure of the recording head 9 will now be described. The recording head 9 is configured to discharge liquid ink (a kind of liquid in the invention) in the form of droplets while being moved by the carriage moving mechanism 14 in the main scanning direction. As shown in FIG. 2, the recording head 9 includes a vibrator unit 28, a case 29, and a flow path unit 30. The vibrator unit 28 includes a plurality of piezoelectric vibrators 19, a fixing plate 26, a flexible cable 27, and so forth, which are unitized. The case 29 accommodates the vibrator unit 28. The flow path unit 30 is joined to the front surface of the case 29.

The case 29 is a block-like member formed of a synthetic resin. The case 29 has a space 31 formed therein, both the front and rear ends of the space 31 being open Such that the vibrator unit 28 may be fixed in the space 31.

The piezoelectric vibrators 19 are pressure generators and are vertically elongated and comb-shaped. Each piezoelectric vibrator 19 is a laminated piezoelectric vibrator with alternating layers of piezoelectric material and internal electrode material, and are vertical vibration mode piezoelectric vibrators capable of expanding and contracting in the vertical direction perpendicular to the laminating direction. The front surface of each piezoelectric vibrator 19 is joined to an island 32 of the flow path unit 30. Each piezoelectric vibrator 19 behaves like a capacitor. Thus, when the supply of a signal is stopped, the potential of the piezoelectric vibrator 19 (vibrator potential) is held to the potential before the stop.

The flow path unit 30 includes in sequence a nozzle plate 34, a flow path forming plate 33, and an elastic plate 35.

The nozzle plate 34 is a thin metal plate (such as, a stainless plate) having a plurality of (here, 180) nozzle openings 25 along the sub-scanning direction. The flow path forming substrate 33 is a plate-like member having a common ink chamber 36 and continuous ink flow paths, each including an ink supply path 37, a pressure chamber 38, and a nozzle communicating path 39. In one embodiment, the flow path forming substrate 33 is made by etching a silicon wafer. The elastic plate 35 is a two-tiered composite plate including a stainless supporting plate 40 with a resin film laminated thereon. Portions of the supporting plate 40 corresponding to the pressure chambers 38 are circularly removed so that the island 32 is formed.

In the recording head 9, each nozzle opening 25 is provided with an ink flow path leading from the common ink chamber 36 through the corresponding pressure chamber 38. Each piezoelectric vibrator 19 may be deformed by being charged and discharged. Thus, each vertical vibration mode piezoelectric vibrator 19 contracts in the longitudinal direction by being charged and expands in the longitudinal direction by being discharged. Therefore, when the vibrator potential is raised by charging, the island 32 is pulled by the piezoelectric vibrator 19, the resin film 41 around the island 32 deforms, and the pressure chamber 38 expands. When the vibrator potential is lowered by discharging, the pressure chamber 38 contracts.

Since the capacity of each pressure chamber 38 can be controlled according to the vibrator potential, the pressure of the ink in the pressure chamber 38 can fluctuate, and ink droplets can be discharged from the corresponding nozzle opening 25. For example, by expanding and then rapidly contracting a pressure chamber 38 of normal capacity (reference capacity), an ink droplet can be discharged.

Figure 4:
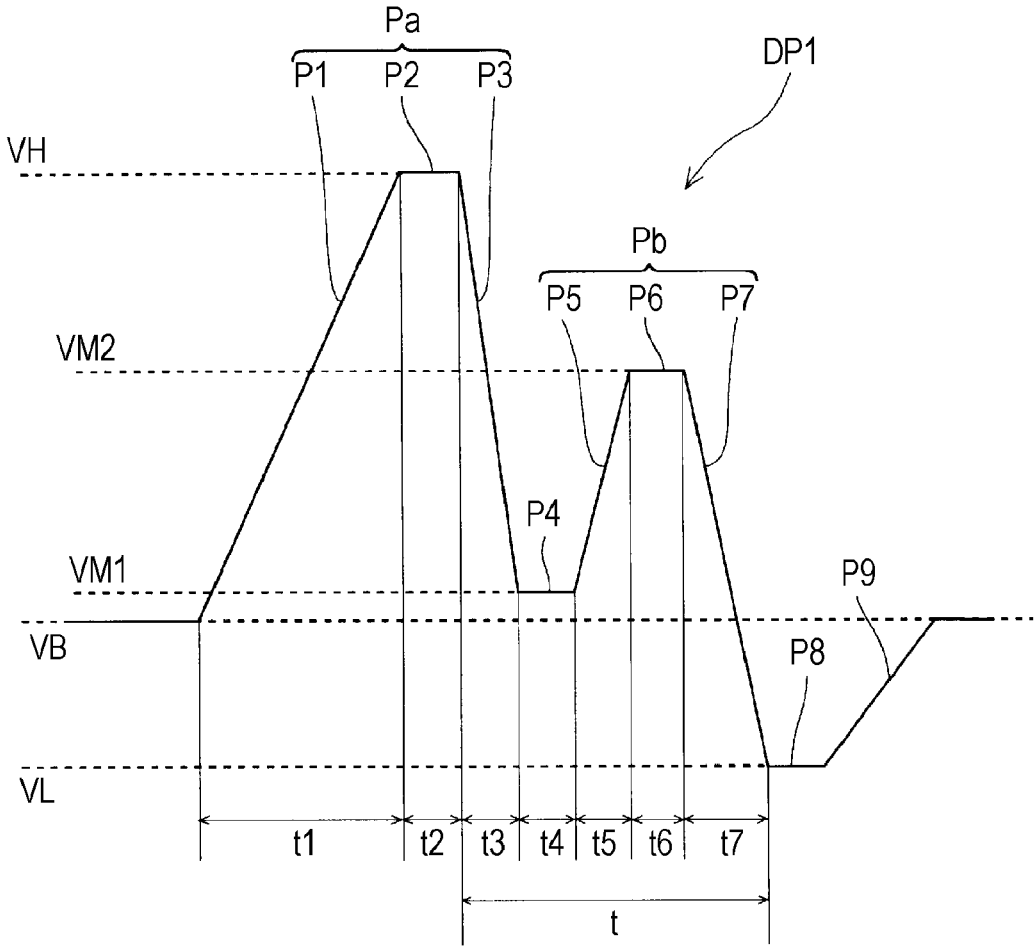
FIG. 4 is a schematic view of a small dot discharge pulse.

Next, the drive pulse DP of the drive signal generated by the drive signal generating circuit 10 will be described. As shown in FIG. 3, the drive pulse DP includes, two small dot discharge pulses DP1 and a connecting element PC that connects the pulses which is not supplied to the piezoelectric vibrators 19. Each small dot discharge pulse DP1 is a pulse for discharging a tiny amount (for example, several pl) of ink droplet from a nozzle openings 25. As shown in FIG. 4, each small dot discharge pulse DP1 includes a discharging main element Pa (P1 to P3) for discharging an ink droplet from a nozzle opening 25, and a discharge damping element Pb (P5 to P7) for converging the residual vibration of the ink in the pressure chamber 38 generated by the discharging main element Pa. The discharge damping element Pb is sent after the discharging main element Pa.

The small dot discharge pulse DP1 includes the following elements P1 to P9. A first expanding element P1 raises the potential from a reference potential VB to the highest potential VH in a regular at a comparatively gradual gradient so as not to discharge an ink droplet. Following the first expanding element P1, a first expansion holding element P2 is generated which maintains the highest potential VH for a very short time (for example, t2=1 μs). Following the first expansion holding element P2, a first discharging element P3 is generated that lowers the potential from the highest potential VH to a first intermediate potential VM1 at a comparatively steep gradient. Following the first discharging element P3, a second contraction holding element P4 is generated which maintains the first intermediate potential VM1 for a very short time (for example, t4=1 μs). Following the second contraction holding element P4, a second expanding element P5 is generated which raises the potential from the first intermediate potential VM1 slightly to an intermediate potential VM2. A second expansion holding element P6 maintains the second intermediate potential VM2 for a very short time (for example, t6=1 μs). Following the second expansion holding element P6, a second contracting element P7 is generated that lowers the potential from the second intermediate potential VM2 to the lowest potential VL at a comparatively steep gradient. A third holding element P8 maintains the lowest potential VL for a predetermined time. A third expanding element P9 returns the potential from the lowest potential VL to the reference potential VB. The supply durations t2, t4, and t6 of the holding elements P2, P4, and P6 are set to a predetermined time, for example, in the range of 0.5 to 3 μs, in order to discharge a predetermined ink droplet. In the preferred embodiment, each supply duration is set to 1 μs. Generally, the shorter the supply durations of the holding elements, the smaller the width of the small dot discharge pulse, and the higher the recording speed. However, it is not always appropriate to set the duration t6 to a short time. As described below, it is preferable to set the duration t6 to a predetermined time based on the natural vibration period Tc of the ink in the pressure chamber 38 and the natural vibration period Ta of the piezoelectric vibrator 19.

The operation of the piezoelectric vibrator 19 and the corresponding pressure chamber 38 in response to the supply of the small dot discharge pulse DP1 will now be described. When the first expanding element P1 is sent, the piezoelectric vibrator 19 contracts significantly, and the pressure chamber 38 expands from its normal capacity (reference capacity) to its maximum capacity. During this expansion, the pressure chamber 38 is depressurized, and the ink meniscus is pulled significantly into the pressure chamber 38. The expanded state of the pressure chamber 38 is maintained and the meniscus vibrates freely during the supply duration of the first expansion holding element P2.

Next, the first discharging element P3 is supplied and the piezoelectric vibrator 19 lengthens significantly, causing the pressure chamber 38 to contract rapidly to an intermediate capacity (a capacity defined by the first intermediate potential VM1). During this contraction, the ink in the pressure chamber 38 is pressurized, and an ink droplet is discharged from the corresponding nozzle opening 25. Following the first discharging element P3, the second contraction holding element P4 is supplied and the contracted state of the pressure chamber 38 is maintained. At this time, the meniscus vibrates significantly due to the discharge of an ink droplet. That is to say, the ink in the pressure chamber 38 is vibrating residually. When the second expanding element P5 is supplied, the piezoelectric vibrator 19 contracts, causing the pressure chamber 38 to expand again. The second expansion holding element P6 maintains this expanded state. The second contracting element P7 causes the piezoelectric vibrator 19 to lengthen, and the pressure chamber 38 is contracted again rapidly to the smallest capacity. In this way, the supply of the first discharging element P3 is followed by the discharge damping element Pb (P5 to P7), and a series of capacity fluctuations are caused to the pressure chamber 38. Thereby, the residual vibration of the meniscus (the residual vibration of the ink in the pressure chamber 38) due to the discharge of an ink droplet is given a pressure fluctuation of the opposite phase. Thus, the residual vibration is damped (that is to say, stabilized), and consequently, may be converged in a short time. Next, the third holding element P8 and the third expanding element P9 are sequentially supplied to the piezoelectric vibrator 19, and the pressure chamber 38 returns to its normal capacity.

Figure 6:
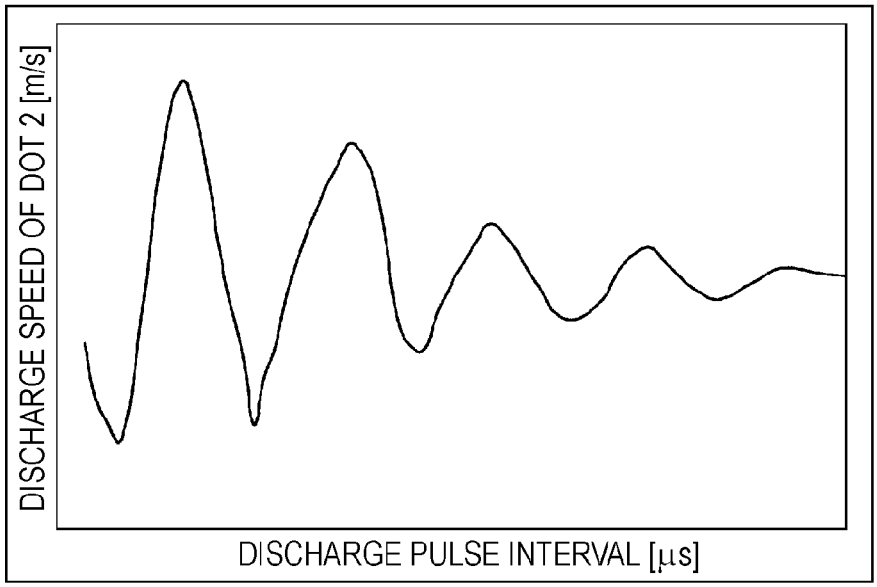
FIG. 6 is a graph showing the relationship between the dot discharge interval and the discharge speed of dot 2.
Figure 7:
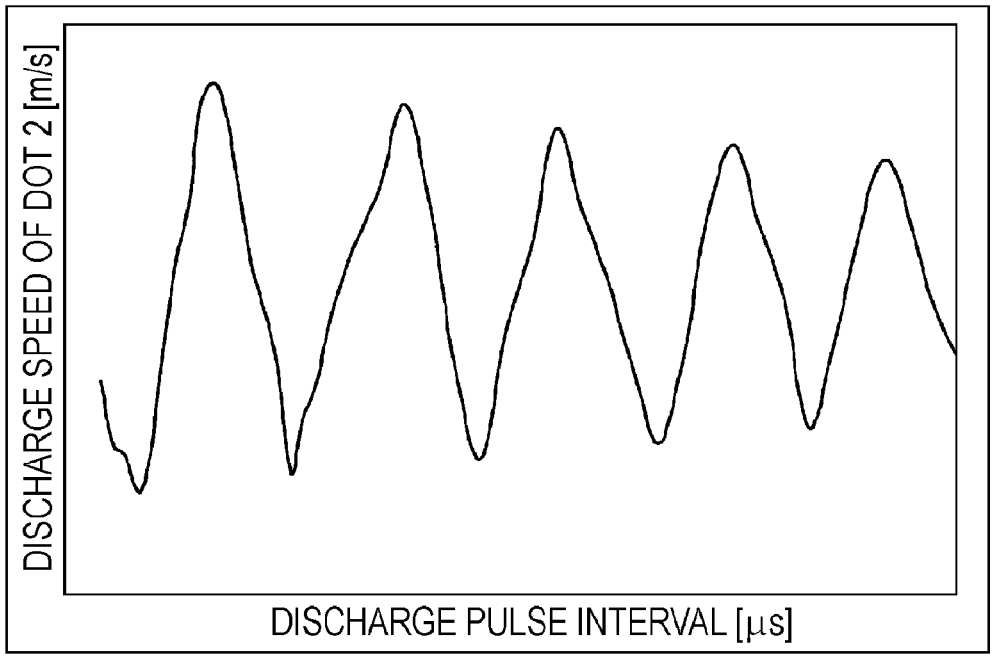
FIG. 7 is a graph showing the relationship between the dot discharge interval and the speed of discharge in the known art.

In one embodiment, the time from the beginning of the first discharging element P3 to the end of the second contraction element P7 of the small dot discharge pulse DP1, i.e., the supply durations of the pulse elements P3 to P7 ($t=t3+t4+t5+t6+t7$ in FIG. 4) is set to between ½ to 1 of the natural vibration period Tc of the ink in the pressure chamber 38 (i.e., $Tc/2 \leqq t \leqq Tc$). During a vibration cycle of the ink in the pressure chamber 38 due to the natural vibration period Tc, a large pressure fluctuation associated with a discharge is applied to the ink in the pressure chamber 38. Thereafter, the pressure chamber 38 is again expanded and then contracted so as to be pressurized. Thus, the residual vibration after the discharge is damped. Thus the behavior of the ink in the pressure chamber 38 can be quickly stabilized. Therefore, the residual vibration of the ink in the pressure chamber 38 can be quickly converged. Thus, by sequentially supplying the first discharging element P3, the second contraction holding element P4, the second expanding element P5, the second expansion holding element P6, and the second contracting element P7 to the piezoelectric vibrator 19 within the natural vibration period Tc of the ink in the pressure chamber 38, the residual vibration of the ink in the pressure chamber 38 can be more quickly converged. Therefore, in the case where ink droplets (for example, dots 1 and 2) are successively discharged as shown in FIG. 3, the residual vibration of the ink in the pressure chamber 38 can be stabilized and converged in a short time after the first ink droplet (dot 1) is discharged. Therefore, as shown in FIG. 6, the discharge speed of the next droplet (dot 2) can be stabilized in a shorter time than in the previous art (see FIG. 7). Therefore, the time between the discharge of the first ink droplet to the next discharge, i.e., the discharge pulse interval t0 can be shortened. Consequently, recording using minute ink droplets (small dots) can be faster. Experiments confirm that the residual vibration of the ink in the pressure chamber 38 can be effectively controlled when the time from the beginning of the first discharging element P3 to the end of the second contracting element is ½ to 1 of the natural vibration period Tc of the ink in the pressure chamber 38.

Additionally, in another embodiment, the supply duration t5 of the second expanding element P5, i.e., the time from the beginning to the end of the second expansion element P5 is less than or equal to the natural vibration period Ta of the piezoelectric vibrator 19 (i.e., t5≦Ta). Using this configuration, the vibration due to the natural vibration period Ta of the piezoelectric vibrator 19 can be prevented from affecting the ink in the pressure chamber 38 when the ink in the pressure chamber 38 is depressurized. Therefore, destabilization of the ink in the pressure chamber 38 after the discharge of an ink droplet can be prevented and the residual vibration of ink can be easily converged. Since the discharge pulse interval t0 can be shortened, the recording speed with minute ink droplets can be further improved. In addition, the sum of the supply duration t5 of the second expanding element P5 and the supply duration t6 of the second expansion holding element P6, (i.e. the time from the beginning of the second expanding element P5 to the beginning of the second contracting element P7) may be less than or equal to the natural vibration period Ta of the piezoelectric vibrator 19 (i.e., t5+t6≦Ta). Thus, the same advantages as found when t5≦Ta are obtained, and the recording time with minute ink droplets can be shortened. In the preferred embodiment, t5 or (t5+t6) is set to 2 μs or less.

In addition, the supply duration t7 of the second contracting element P7, (i.e. the time from the beginning to the end of the second contracting element P7) is less than or equal to the natural vibration period Ta of the piezoelectric vibrator 19 (t7≦Ta). Similar to the above cases, the vibration due to the natural vibration period Ta of the piezoelectric vibrator 19 can be prevented from affecting the ink in the pressure chamber 38 when the ink in the pressure chamber 38 depressurized by supplying the second expanding element P2 is again pressurized. Therefore, the destabilization of the ink in the pressure chamber 38 after the discharge of an ink droplet can be prevented, and the residual vibration of ink can be easily converged. Therefore, recording with minute ink droplets can be further improved. In a preferred embodiment t7 is set to 2 μs or less.

In addition, in a case which combines the above-described settings, (i.e. t5≦Ta and t7≦Ta, or t5+t6≦Ta and t7≦Ta) the vibration due to the natural vibration period Ta of the piezoelectric vibrator 19 can be prevented from affecting the ink in the pressure chamber 38 when the second expansion element P5 is supplied to pull the ink (meniscus) into the pressure chamber 38. In addition, by supplying the second contraction element P7 before the meniscus rebounds outward, the ink (meniscus) can be pushed outward without being discharged. Therefore, the ink in the pressure chamber 38 can be prevented from being affected by the vibration due to the natural vibration period Ta of the piezoelectric vibrator 19. In addition, the discharge damping element Pb (particularly P7) can be supplied without destabilizing the meniscus (the ink in the pressure chamber 38). Therefore, the ink in the pressure chamber 38 can be more quickly damped. Therefore, the residual vibration of the ink in the pressure chamber 38 after the discharge of an ink droplet can be converged in a shorter time, and the recording process can be further sped up.

The invention is not limited to the above-described embodiment, and various changes may be made therein based on the claims.

Figure 5:
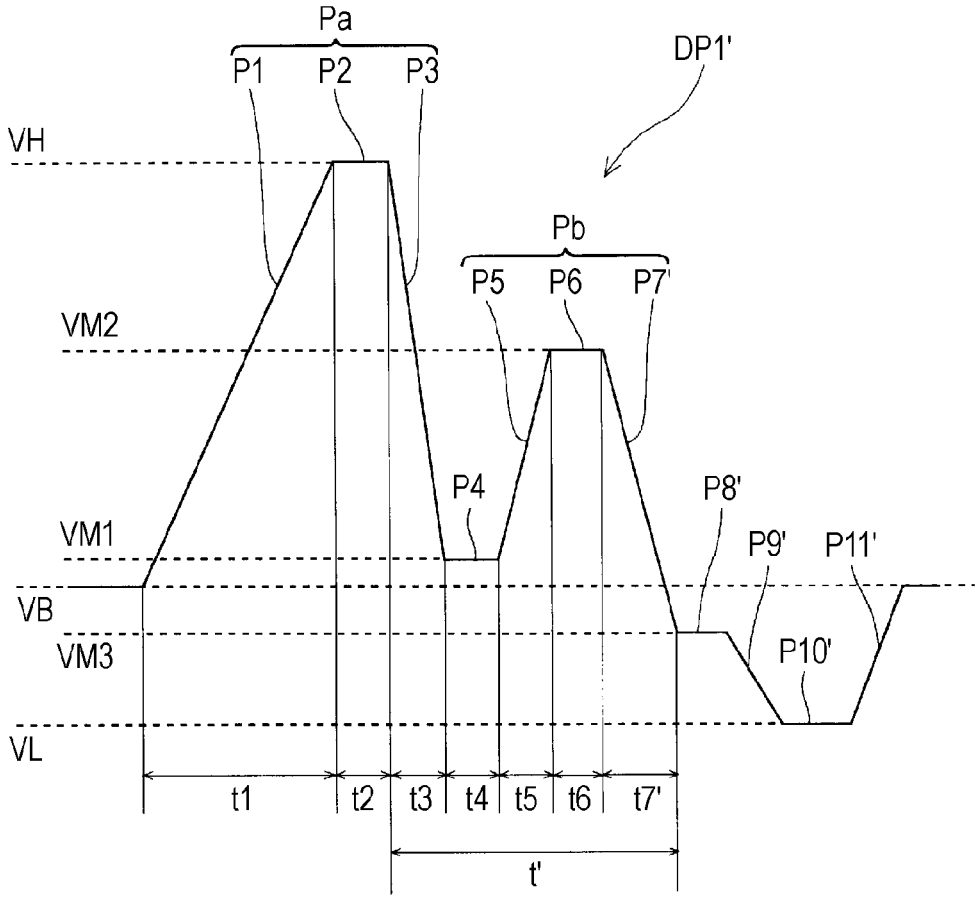
FIG. 5 is a schematic view of a modification of a small dot discharge pulse.

In the above-described embodiment, the small dot discharge pulse DP1 includes, a second contracting element P7 that lowers the potential from the second intermediate potential VM2 to the lowest potential VL at a comparatively steep gradient, a third holding element P8 that maintains the lowest potential VL for a predetermined time, and a third expanding element P9 that returns the potential from the lowest potential VL to the reference potential VB. However, the invention may include a small dot discharge pulse DP1 which includes other waveform elements instead of the elements P7 to P9. FIG. 5 shows a modification of the above embodiment. A small dot discharge pulse DP1' includes, the elements P7', P8', P9', P10', and P11'. The contracting element P7' lowers the potential from the second intermediate potential VM2 to a third intermediate potential VM3 at a comparatively steep gradient. The holding element P8' maintains the third intermediate potential VM3 for a predetermined time. The contracting element P9' lowers the potential from the third intermediate potential VM3 to the lowest potential VL. A contraction holding element P10' maintains the lowest potential VL for a predetermined time. A expanding element P11' returns the potential from the lowest potential VL to the reference potential VB. Also in this case, by replacing t7 and t in the above-described embodiment with t7' and t', respectively, and performing the same setting as the above-described embodiment, the same advantages can be obtained.

In this configuration, during the contraction of the pressure chamber 38 to the smallest capacity, the third holding element P8' and the third contracting element P9' are sequentially supplied, temporarily stopping the contraction. Since the pressure chamber 38 is contracted in a stepwise manner, the pressure fluctuation of the pressure chamber 38 is smaller than in the case where the pressure chamber 38 is continuously contracted. Therefore, the residual vibration of the ink in the pressure chamber 38 can be more quickly converged.

By modifying the waveform elements in order to combine the discharge pulse with other elements depending on conditions, for example, temperature environment, properties of liquid such as ink, and characteristics of the liquid ejecting head, the above-described advantages can also be obtained.

In the above embodiments, the intermediate potentials VM1 and VM2 are higher than the reference potential VB. However, the invention is not limited to this. The potentials of the beginning and the end and the supply duration of each element in the drive pulse of the invention can be appropriately set, based on the claims, depending on the conditions, for example, temperature environment, properties of liquid such as ink, and characteristics of the liquid ejecting head.

In the above embodiments, a so-called vertical vibration mode piezoelectric vibrator 19 is taken as an example of a pressure generator of the invention. However, the invention is not limited to this. For example, a piezoelectric vibrator capable of vibrating in the direction of electric field can be used. The piezoelectric vibrators are not necessarily unitized for each nozzle line but may be provided for each pressure chamber like so-called bending vibration mode piezoelectric vibrators.

The invention can also be applied to liquid ejecting apparatuses having a liquid ejecting head other than the above-described recording head. The invention can also be applied to other apparatuses, including display manufacturing apparatuses, electrode manufacturing apparatuses, chip manufacturing apparatuses, and micro pipettes.

What is claimed is:

1. A liquid ejecting apparatus comprising:

liquid ejecting head having a pressure chamber capable of communicating with a nozzle opening, and a pressure generator capable of causing a pressure fluctuation in the liquid in the pressure chamber, the liquid ejecting head being capable of discharging the liquid in the pressure chamber as liquid droplets by operating of the pressure generator; and a drive signal generator capable of generating a drive signal, the drive signal including a drive pulse for driving the pressure chamber to discharge a liquid droplet;

wherein the drive pulse generated by the drive signal generator includes a first expanding element which is capable of expanding the pressure chamber by raising the drive pulse from a first reference potential to a second reference potential, a first expansion holding element which maintains the first expansion of the pressure chamber at the second reference potential, a first discharging element which is capable of contracting the pressure chamber previously expanded by the first expanding element in order discharge a first liquid droplet by lowering the second reference potential to a third reference potential which is higher than the first reference potential, a second expanding element which is capable of expanding the pressure chamber previously contracted by the first discharging element by raising the drive pulse from the third reference potential to a fourth reference potential which is less than the second reference potential, a second expansion holding element which maintains the second expansion of the pressure chamber at the fourth reference potential, and a second contracting element which is capable of contracting the pressure chamber expanded by the second expanding element by lowering the fourth reference potential to a fifth reference potential which is less than the first reference potential;

wherein the first discharging element contracts the pressure chamber to a level which is greater than the pressure chamber at a beginning of the first expanding element, wherein second expanding element expands the pressure chamber to a lesser degree than the first expanding element expands the pressure chamber, wherein the length of time from the beginning of the first discharging element to the end of the second contracting element is ½ to 1 of the natural vibration period of the liquid in the pressure chamber, and the length of time from the beginning of the second expanding element to the end of the second expanding element is set to less than or equal to the natural vibration period of the pressure generator, and wherein the second expanding element, the second expansion holding element, and the second contracting element are for discharge damping and do not cause a second liquid droplet to be discharged.

2. The liquid ejecting apparatus according to claim 1, wherein the time from the beginning to the end of the second contracting element is set to less than or equal to element is set to less than or equal to the natural vibration period of the pressure generator.

3. The liquid ejecting apparatus according to claim 1, wherein the time from the beginning of the second expanding element to the beginning of the second contracting element is set to less than or equal to the natural vibration period of the pressure generator.

4. A method for controlling a liquid ejecting apparatus including a liquid ejecting head having a pressure chamber, a pressure generator capable of causing a pressure fluctuation to liquid in the pressure chamber, and a drive signal generator that generates a drive signal including a drive pulse for driving the pressure chamber to discharge a liquid droplet from a nozzle opening connected to the pressure chamber, the method comprising:

generating a drive pulse in the drive signal generator which includes a first expanding element that expands the pressure chamber from its normal capacity by raising the drive pulse from a first reference potential to a second reference potential, a first expansion holding element which maintains the first expansion of the pressure chamber at the second reference potential, a first discharging element that contracts the pressure chamber expanded by the first expanding element in order to discharge a first liquid droplet by lowering the second reference potential to a third reference potential which is higher than the first reference potential, a second expanding element that expands the pressure chamber contracted by the first discharging element by raising the drive pulse from the third reference potential to a fourth reference potential which is less than the second reference potential, a second expansion holding element which maintains the second expansion of the pressure chamber at the fourth reference potential, and a second contracting element that contracts the pressure chamber expanded by the second expanding element by lowering the fourth reference potential to a fifth reference potential which is less than the first reference potential, wherein the first discharging element contracts the pressure chamber to a level which is greater than the pressure chamber at a beginning of the first expanding element, wherein second expanding element expands the pressure chamber to a lesser degree than the first expanding element expands the pressure chamber;

setting the time from the beginning of the first discharging element to the end of the second contracting element to ½ to 1 of the natural vibration period of the liquid in the pressure chamber; and setting the time from the beginning to the end of the second expanding element to less than or equal to the natural vibration period of the pressure generator, wherein the second expanding element, the second expansion holding element, and the second contracting element are for discharge damping and do not cause a second liquid droplet to be discharged.

5. The method for controlling a liquid ejecting apparatus according to claim 4, further comprising setting the time from the beginning to the end of the second contracting element to less than or equal to the natural vibration period of the pressure generator.

6. A method for controlling a liquid ejecting apparatus of claim 4, further comprising setting the time from the beginning of the second expanding element to the beginning of the second contracting element to less than or equal to the natural vibration period Ta of the pressure generator.

7. A method for controlling a liquid ejecting apparatus including a liquid ejecting head having a pressure chamber, a pressure generator capable of causing a pressure fluctuation to liquid in the pressure chamber, and a drive signal generator that generates a drive signal including a drive pulse for driving the pressure chamber to discharge a liquid droplet from a nozzle opening connected to the pressure chamber, the method comprising:

generating a drive pulse in the drive signal generator which includes a first expanding element that expands the pressure chamber from its normal capacity by raising the drive pulse from a first reference potential to a second reference potential, a first expansion holding element which maintains the first expansion of the pressure chamber at the second reference potential, a first discharging element that contracts the pressure chamber expanded by the first expanding element in order to discharge a first liquid droplet by lowering the second reference potential to a third reference potential which is higher than the first reference potential, a second expanding element that expands the pressure chamber contracted by the first discharging element by raising the drive pulse from the third reference potential to a fourth reference potential which is less than the second reference potential, a second expansion holding element which maintains the second expansion of the pressure chamber at the fourth reference potential, and a second contracting element that contracts the pressure chamber expanded by the second expanding element by lowering the fourth reference potential to a fifth reference potential which is less than the first reference potential, wherein the first discharging element contracts the pressure chamber to a level which is greater than the pressure chamber at a beginning of the first expanding element, wherein second expanding element expands the pressure chamber to a lesser degree than the first expanding element expands the pressure chamber;

setting the time from the beginning of the first discharging element to the end of the second contracting element to ½ to 1 of the natural vibration period of the liquid in the pressure chamber;

setting the time from the beginning to the end of the second expanding element to less than or equal to the natural vibration period of the pressure generator;

setting the time from the beginning to the end of the second contracting element to less than or equal to the natural vibration period of the pressure generator; and setting the time from the beginning of the second expanding element to the beginning of the second contracting element to less than or equal to the natural vibration period Ta of the pressure generator, wherein the second expanding element, the second expansion holding element, and the second contracting element are for discharge damping and do not cause a second liquid droplet to be discharged.

* * * * *